US011607824B2

(12) United States Patent
Okumura et al.

(10) Patent No.: US 11,607,824 B2
(45) Date of Patent: Mar. 21, 2023

(54) METHOD FOR DRYING HONEYCOMB FORMED BODY AND METHOD FOR MANUFACTURING HONEYCOMB STRUCTURE

(71) Applicant: NGK INSULATORS, LTD., Nagoya (JP)

(72) Inventors: Kensuke Okumura, Nagoya (JP); Norihiro Asakura, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 803 days.

(21) Appl. No.: 16/106,183

(22) Filed: Aug. 21, 2018

(65) Prior Publication Data

US 2018/0354157 A1 Dec. 13, 2018

Related U.S. Application Data

(63) Continuation of application No. PCT/JP2017/003953, filed on Feb. 3, 2017.

(30) Foreign Application Priority Data

Mar. 30, 2016 (JP) ..... JP2016-067010

(51) Int. Cl.
*B28B 11/24* (2006.01)

(52) U.S. Cl.
CPC ..... *B28B 11/241* (2013.01); *B28B 11/243* (2013.01)

(58) Field of Classification Search
CPC .... B28B 11/241; B28B 11/242; B28B 11/243
See application file for complete search history.

(56) References Cited

U.S. PATENT DOCUMENTS 4,837,943 A 6/1989 Mizutani
10,174,996 B2 * 1/2019 Okumura ..... F26B 3/343
(Continued)

FOREIGN PATENT DOCUMENTS

JP S63-166745 A1 7/1988
JP 2002-283329 A1 10/2002
(Continued)

OTHER PUBLICATIONS

A Chinese Office Action (Application No. 201780013425.8) dated Apr. 28, 2020.
(Continued)

*Primary Examiner* — Michael P Wieczorek
(74) *Attorney, Agent, or Firm* — Burr Patent Law, PLLC

(57) ABSTRACT

A method for drying a honeycomb formed body, the honeycomb formed body being an unfired honeycomb formed body including a raw material composition containing a ceramic raw material and water, the method including: a dielectric drying process of obtaining a primary dried honeycomb formed body from which 30 to 70% of entire moisture contained in the unfired honeycomb formed body before the drying is removed by performing dielectric drying on the unfired honeycomb formed body while maintaining a temperature of a central portion of the unfired honeycomb formed body at 100° C. or less; and a microwave drying process of obtaining a honeycomb dried body from which residual moisture is removed by performing microwave drying on the primary dried honeycomb formed body obtained in the dielectric drying process.

4 Claims, 3 Drawing Sheets

(56) References Cited

U.S. PATENT DOCUMENTS

| | | | | |
|---|---|---|---|---|
| 2002/0093123 | A1 | 7/2002 | Miura et al. | |
| 2007/0006480 | A1 | 1/2007 | Ishii et al. | |
| 2009/0235552 | A1* | 9/2009 | Takagi | C04B 35/486 34/437 |
| 2010/0078859 | A1 | 4/2010 | Takagi et al. | |
| 2011/0227256 | A1* | 9/2011 | Okumura | F26B 3/343 264/414 |
| 2014/0294688 | A1 | 10/2014 | Mase et al. | |
| 2015/0210601 | A1 | 7/2015 | Makino et al. | |

FOREIGN PATENT DOCUMENTS

| | | | |
|---|---|---|---|
| JP | 2009-226633 | A1 | 10/2009 |
| JP | 2010-076328 | A1 | 4/2010 |
| JP | 2011-195344 | A1 | 10/2011 |
| JP | 2014-198446 | A1 | 10/2014 |
| WO | 2005/023503 | A1 | 3/2005 |
| WO | 2014/054167 | A1 | 4/2014 |

OTHER PUBLICATIONS

International Search Report and Written Opinion (Application No. PCT/JP2017/003953) dated Apr. 4, 2017.

* cited by examiner

METHOD FOR DRYING HONEYCOMB FORMED BODY AND METHOD FOR MANUFACTURING HONEYCOMB STRUCTURE

BACKGROUND OF THE INVENTION

1. Field of the Invention

The present invention relates to a method for drying a honeycomb formed body and a method for manufacturing a honeycomb structure. More particularly, the present invention relates to a method for drying a honeycomb formed body and a method for manufacturing a honeycomb structure capable of obtaining a honeycomb dried body having good quality with high productivity by uniformly drying the honeycomb formed body due to a small deviation in temperature distribution in the honeycomb formed body during the drying.

2. Description of Related Art

In the related art, a honeycomb structure made of a ceramic material has been widely used in a catalyst carrier, various filters, or the like. Further, this honeycomb structure made of the ceramic material has also been used as a diesel particulate filter (DPF) for capturing a particulate matter (PM) discharged from a diesel engine.

Generally, the honeycomb structure as described above can be obtained by extruding a kneaded material to manufacture a formed body having a honeycomb shape (a honeycomb formed body) and drying and then firing the honeycomb formed body. Noet that the kneaded material is obtained by kneading raw materials obtained by adding various additives such as water, a binder, and the like to a ceramic material.

In addition, as means for drying the honeycomb formed body, the following method is known. Specifically, a natural drying method of simply leaving the honeycomb formed body under a room temperature condition, a hot air drying method of introducing hot air generated by a gas burner to perform the drying, a dielectric drying method, a microwave drying method using microwaves, and the like have been known (for example, see Patent Documents 1 and 2). Note that, in the dielectric drying method, drying is perfromed using high-frequency energy generated by passing a current between electrodes provided upper and lower sides of the honeycomb formed body.

CITATION LIST

Patent Documents

[Patent Document 1] JP-A-63-166745
[Patent Document 2] JP-A-2002-283329

SUMMARY OF THE INVENTION

Problem to be Solved by the Invention

However, if a drying method uses only dielectric drying or microwave drying as in the methods for drying a honeycomb structure disclosed in Patent Documents 1 and 2, there are problems as described below. That is, for example, in a drying process of a honeycomb formed body made of cordierite, drying proceeds with heating distributions in each of the dielectric drying and the microwave drying. For this reason, the drying proceeds in a state in which there is a large difference in dimensions at one end portion, the other end portion, and an intermediate portion of the honeycomb formed body. As a result, in some cases, the obtained honeycomb dried body does not satisfy specified dimensions. Accordingly, it takes time and effort to adjust the dimensions by a method for grinding an outer peripheral portion of the honeycomb dried body, for example, which may cause problems that productivity of the honeycomb structure as a final product is lowered and it is difficult to produce the honeycomb structure.

The present invention is made in view of such problems. The present invention provides a method for drying a honeycomb formed body and a method for manufacturing a honeycomb structure capable of obtaining a honeycomb dried body having good quality with high productivity by uniformly drying the honeycomb formed body due to a small deviation in temperature distribution in the honeycomb formed body during the drying.

Means for Solving the Problem

According to a first aspect of the present invention, a method for drying a honeycomb formed body is provided, the honeycomb formed body being an unfired honeycomb formed body including a raw material composition containing a ceramic raw material and water, and including a cell wall that defines and forms a plurality of cells extended from a first end face as one end face to a second end face as the other end face, the method including: a dielectric drying process of obtaining a primary dried honeycomb formed body from which 30 to 70% of entire moisture contained in the unfired honeycomb formed body before the drying is removed by performing dielectric drying on the unfired honeycomb formed body while maintaining a temperature of a central portion of the unfired honeycomb formed body at 100° C. or less; and a microwave drying process of obtaining a honeycomb dried body from which residual moisture is removed by performing microwave drying on the primary dried honeycomb formed body obtained in the dielectric drying process.

According to a second aspect of the present invention, the method for drying a honeycomb formed body according to the first aspect is provided, wherein a moisture content of the unfired honeycomb formed body before the drying subjected to the dielectric drying process is 20 to 60%.

According to a third aspect of the present invention, the method for drying a honeycomb formed body according to the first or second aspects is provided, wherein the unfired honeycomb formed body subjected to the dielectric drying process has a round pillar shape, a diameter of the end face of the unfired honeycomb formed body is 50 to 200 mm, a length of the unfired honeycomb formed body in a direction in which the cell extends is 150 to 350 mm, and a thickness of the cell wall of the unfired honeycomb formed body is 50 to 350 μm.

According to a fourth aspect of the present invention, a method for manufacturing a honeycomb structure is provided, the method including: a honeycomb formed body manufacturing process of manufacturing a honeycomb formed body by kneading a raw material obtained by adding additives to a ceramic material to form a kneaded material and extruding the kneaded material in a honeycomb shape; a drying process of obtaining a honeycomb dried body by drying the manufactured honeycomb formed body using the method for drying a honeycomb formed body according to any one of the first through third aspects; and a firing process of obtaining the honeycomb structure by firing the obtained honeycomb dried body.

Effect of the Invention

With a method for drying a honeycomb formed body according to the present invention, a honeycomb formed body can be uniformly dried due to a small deviation in temperature distribution in the honeycomb formed body during the drying, thereby making it possible to obtain a honeycomb dried body having good quality with high productivity.

With a method for manufacturing a honeycomb structure according to the present invention, it is possible to obtain a honeycomb structure having good quality with high productivity.

DETAILED DESCRIPTION OF THE INVENTION

Hereinafter, embodiments of the present invention will be described in detail with reference to the accompanying drawings. The present invention is not limited to the following embodiments. It should be understood that those in which changes, improvements, and the like have been appropriately added to the following embodiments based on the ordinary knowledge of those skilled in the art without departing from the spirit of the present invention fall within the scope of the present invention.

Figure 1:
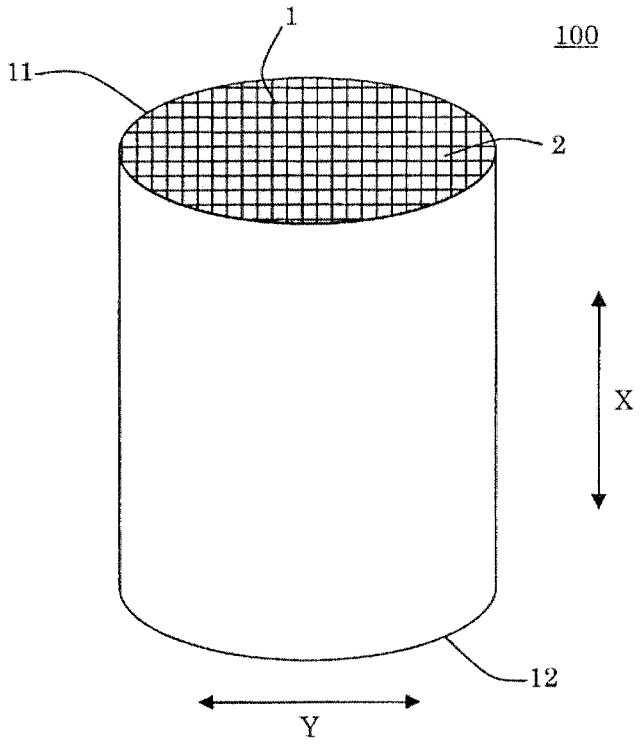
FIG. 1 is a perspective view schematically showing an embodiment of an object to be dried in a method for drying a honeycomb formed body according to the present invention.

(1) Method for Drying Honeycomb Formed Body:

A method for drying a honeycomb formed body according to the present invention is a method for drying an unfired honeycomb formed body 100 including a raw material composition containing a ceramic raw material and water, and including a cell wall 1 that defines and forms a plurality of cells 2 extended from a first end face 11 as one end face to a second end face 12 as the other end face. That is, the method for drying a honeycomb formed body according to the present invention is a method for drying an unfired honeycomb formed body. Specifically, the method for drying a honeycomb formed body according to the present invention is a method for manufacturing a dried unfired honeycomb formed body (honeycomb dried body) from an unfired honeycomb formed body that is not dried (that is, the honeycomb formed body containing moisture and being in a clay state). Note that the unfired honeycomb formed body refers to a state in which particles of the ceramic raw material exist in a state where a particle shape when the raw material composition is formed into a honeycomb shape is maintained and the ceramic raw material is not sintered. FIG. 1 is a perspective view schematically showing an embodiment of an object to be dried in the method for drying a honeycomb formed body according to the present invention.

The method for drying a honeycomb formed body according to the present invention has a dielectric drying process and a microwave drying process. The dielectric drying process is a process of obtaining a primary dried honeycomb formed body containing moisture in a content of 30 to 70% of entire moisture of the unfired honeycomb formed body by performing dielectric drying on the unfired honeycomb formed body while maintaining a temperature of a central portion of the unfired honeycomb formed body at 100° C. or less. Further, the microwave drying process is a process of obtaining a honeycomb dried body by performing microwave drying on the primary dried honeycomb formed body obtained in the dielectric drying process.

With the method for drying a honeycomb formed body as described above, a deviation in temperature distribution in the honeycomb formed body during the drying is decreased by optimally determining distribution of dielectric drying and microwave drying. Accordingly, a deviation in a dimension (dimension in a direction in which the cell extends) of the obtained honeycomb dried body is improved. As a result, quality of a product can be easily secured, and productivity is improved.

(1-1) Dielectric Drying Process

In the present process, the primary dried honeycomb formed body from which 30 to 70% of the entire moisture contained in the unfired honeycomb formed body before the drying is removed is obtained. That is, the present process is terminated when 30 to 70% of the entire moisture contained in the unfired honeycomb formed body before the drying is removed, and the process proceeds to the microwave drying process. In the dielectric drying, heating is started from a center portion of a product, and in the microwave drying, heating is started from an outer surface thereof. In the case of drying the product only using any one of the drying methods, the heating is concentrated on the center portion or the outer surface. Therefore, it is possible to decrease a temperature difference between the center portion and the outer surface by combining both of the drying methods. However, in the case of performing the microwave drying first, since the outer surface is heated first and drying shrinkage occurs from an outer skin (the outer surface), pressure is applied to the inside of the product (honeycomb formed body), such that deformation of the cell occurs.

Figure 2:
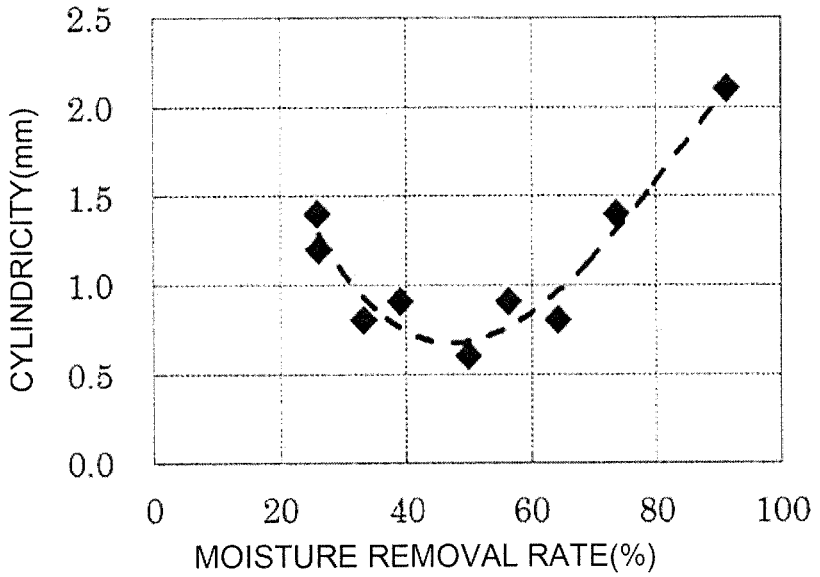
FIG. 2 is a graph showing a relationship between a moisture removal rate and a cylindricity in the method for drying a honeycomb formed body according to the present invention.

FIG. 2 is a graph showing a relationship between a moisture content and cylindricity of the primary dried honeycomb formed body in the method for drying the honeycomb formed body of the present invention. Note that the cylindricity means a difference between a maximum dimension and a minimum dimension at the time of measuring a dimension (the outer diameter (see symbol Y in FIG. 1)) of the honeycomb dried body at a plurality of positions in the direction in which the cell extends (an X direction in FIG. 1).

Whether the moisture content of the primary dried honeycomb formed body is within the above range or not is judged as follows. The moisture content of the unfired honeycomb formed body before the drying is calculated by measuring a wet mixed powder with an infrared heating type moisture meter. The moisture content of the primary dried honeycomb formed body is calculated from an amount of scattered moisture by measuring a weight of the unfired honeycomb formed body before the drying and a weight of the honeycomb formed body after the dielectric drying (the primary dried honeycomb formed body). In this way, the primary dried honeycomb formed body from which 30 to 70% of the entire moisture contained in the unfired honeycomb formed body before the drying is removed can be obtained. Note that it is possible to perform the dielectric drying in advance under a plurality of drying conditions, and confirm conditions under which the moisture content of the primary dried honeycomb formed body is within the above range.

As described above, from the primary dried honeycomb formed body, 30 to 70% of the entire moisture contained in the unfired honeycomb formed body before the drying needs to be removed. In addition, it is preferable that, from the primary dried honeycomb formed body, 40 to 60% of the entire moisture contained in the unfired honeycomb formed body before the drying is removed. Further, it is more preferable that, from the primary dried honeycomb formed body, 40 to 50% of the entire moisture contained in the unfired honeycomb formed body before the drying is removed.

In the present process, there is a need to perform the dielectric drying on the unfired honeycomb formed body while maintaining a temperature of the central portion of the unfired honeycomb formed body to 100° C. or less. It is possible to prevent a locally dried portion from being generated in the unfired honeycomb formed body by maintaining the temperature of the central portion of the unfired honeycomb formed body to 100° C. or less as described above. The reason is that when the locally dried portion is generated, thermal stress is generated in this portion, such that cracks are likely to occur. Note that the reason to measure the temperature of the central portion of the unfired honeycomb formed body is that the central portion has the highest temperature in the dielectric drying. That is, the reason is that when the temperature of the central portion is 100° C. or less, temperatures of other portions are also 100° C. or less. The temperature of the central portion of the unfired honeycomb formed body is a value measured by an optical fiber thermometer.

In the present process, conditions for performing the dielectric drying on the unfired honeycomb formed body while maintaining the temperature of the central portion of the unfired honeycomb formed body to 100° C. or less can be suitably determined. Specifically, in a preliminary test, a small temperature measuring device is embedded in the product (unfired honeycomb formed body before the drying), and an output and a drying time of a dryer capable of maintaining the temperature of the central portion at 100° C. or less is determined. The conditions for performing the dielectric drying can be set as described above.

Since the moisture content differs depending on characteristics required for the product, the output and the drying time of the dryer are set depending on the moisture content. An applicable moisture content is in a range of 20 to 60%. Note that the moisture content of the "unfired honeycomb formed body" is a value obtained by measuring a wet mixed powder with an infrared heating type moisture meter.

In the dielectric drying of the unfired honeycomb formed body corresponding to the present process, generally, a frequency of 10 to 50 MHz is used.

(1-1-1) Formation of Unfired Honeycomb Formed Body:

The unfired honeycomb formed body can be manufactured by a method known in the art. Specifically, first, the unfired honeycomb formed body including the cell wall that defines and forms the plurality of cells extended from the first end face as one end face to the second end face as the other end face is formed by molding the raw material composition containing the ceramic raw material and water.

As the ceramic raw material contained in the raw material composition, at least one selected from the group consisting of a cordierite forming raw material, cordierite, silicon carbide, a silicon-silicon carbide based composite material, mullite, and aluminum titanate is preferable. Note that the cordierite forming raw material is a ceramic raw material blended so as to have a chemical composition in which a silica content is 42 to 56 mass %, an alumina content is 30 to 45 mass %, and a magnesia content is 12 to 16 mass %. In addition, the cordierite forming raw material is fired to become cordierite.

The raw material composition can be prepared by mixing a dispersing medium, an organic binder, an inorganic binder, a pore former, a surfactant, and the like in addition to the ceramic raw material and water. A composition ratio of each raw material is not particularly limited, and it is preferable to set the composition ratio depending on a structure, a material, and the like of the honeycomb structure to be manufactured.

At the time of forming the raw material composition, first, the raw material composition is kneaded to form a kneaded material, and the obtained kneaded material is formed in a honeycomb shape. As a method for kneading the raw material composition to form the kneaded material, for example, a method using a kneader, a vacuum pugmill, or the like can be mentioned. As a method for molding the kneaded material to form the honeycomb formed body, for example, known molding methods such as an extrusion method and an injection molding method can be used. Specifically, a preferable example of the method can include a method for forming a honeycomb formed body by extrusion using a die having a desired cell shape, a desired thickness of a partition wall (cell wall) and a desired cell density and the like. As a material of the die, a cemented carbide, which is hardly abraded, can be used.

A cell shape (a cell shape in a cross section orthogonal to the direction in which the cell extends) of the unfired honeycomb formed body is not particularly limited. Examples of the cell shape can include a triangle, a square, a hexagon, an octagon, a circle, or a combination thereof.

Examples of a shape of the honeycomb formed body include a round pillar shape, an elliptic pillar shape, and a polygonal pillar shape of which an end face has a "square, rectangular, triangular, pentagonal, hexagonal, octagonal or the like" shape.

As described above, the unfired honeycomb formed body can have a round pillar shape, and in this case, a diameter of the end face of the unfired honeycomb formed body is preferably 50 to 200 mm. Further, it is preferable that a length of the unfired honeycomb formed body in the direction in which the cell extends is 150 to 350 mm. It is preferable that the thickness of the cell wall of the unfired honeycomb formed body is 50 to 350 μm. In the case of drying an unfired honeycomb formed body satisfying the above-mentioned conditions, the deviation in temperature distribution in the honeycomb formed body during the drying is further decreased, thereby making it possible to more uniformly dry the honeycomb formed body. For this reason, the honeycomb dried body having better quality can be obtained with high productivity.

(1-2) Microwave Drying Process

In the microwave drying of the honeycomb formed body corresponding to the present process, generally, a frequency of 1,000 to 10,000 MHz is used.

An output of microwaves in the microwave drying in the present process is set so that a temperature of the honeycomb dried body does not exceed 150° C. in consideration of a possibility of ignition of the binder or the like contained in the honeycomb formed body. A drying time is set by measuring a weight of the honeycomb formed body so that the moisture content is decreased to a level at which the residual moisture does not have an influence in a firing process.

(2) Method for Manufacturing Honeycomb Structure:

An embodiment of a method for manufacturing a honeycomb structure according to the present invention has a honeycomb formed body manufacturing process, a drying process, and a firing process. The honeycomb structure can be manufactured by these processes. With the method for manufacturing a honeycomb structure according to the present invention, it is possible to obtain a honeycomb structure having good quality (that is, a honeycomb structure of which a difference (cylindricity) between a maximum dimension and a minimum dimension in an entire side face of the honeycomb structure is small) with high productivity.

In the honeycomb formed body manufacturing process, first, a kneaded material can be prepared as described above. That is, the kneaded material is formed by kneading raw materials obtained by adding various additives such as water and a binder to a ceramic raw material (ceramic material). Thereafter, a formed body having a honeycomb shape (honeycomb formed body) is manufactured by extruding the kneaded material.

In the drying process, a honeycomb dried body is obtained by drying the honeycomb formed body manufactured in the honeycomb formed body manufacturing process using the method for drying a honeycomb formed body according to the present invention described above.

In the firing process, the honeycomb structure is obtained by firing the honeycomb dried body obtained in the drying process. As firing conditions, conditions known in the art can be suitably adopted.

EXAMPLES

Hereinafter, the present invention is described in more detail through Examples. The present invention is in no way limited by these Examples.

Example 1

First, a kneaded material was obtained by using a cordierite forming raw material prepared by mixing alumina, kaolin, and talc as a ceramic raw material, and mixing and kneading a binder including an organic binder, a pore former, and water (73 mass %) as a dispersing medium therewith.

An unfired honeycomb formed body having a cell having a square shaped cross section orthogonal to a direction in which the cell was extended was obtained by extruding the obtained kneaded material. This unfired honeycomb formed body had a diameter (a maximum length in a Y direction in FIG. 1) of 126 mm and a length (a length in the direction in which the cell was extended (length in an X direction in FIG. 1) of 220 mm, and an external shape thereof was a round pillar shape.

A moisture content of the obtained unfired honeycomb formed body was 42%, a cell density thereof was 40 cells/cm$^2$, a thickness of a cell wall was 210 μm, and a mass thereof was 1250 g. A total of two unfired honeycomb formed bodies as described above were prepared, and a drying operation was performed thereof as follows.

The obtained unfired honeycomb formed body was subjected to dielectric drying in a batch using a dielectric drying apparatus at a frequency of 13 MHz, an output of 5 kW, and a heating time of 500 seconds (dielectric drying process). As described above, a primary dried honeycomb formed body from which 64% of the entire moisture contained in the unfired honeycomb formed body before the drying was removed was obtained. Note that, under the drying conditions as described above, it was confirmed beforehand by measurement using an optical fiber thermometer that a temperature of a central portion of the unfired honeycomb formed body was 100° C. Incidentally, a ratio of moisture removed from the entire moisture contained in the unfired honeycomb formed body before the drying was indicated as a "moisture removal rate (%)" in Table 1.

Next, the primary dried honeycomb formed body was subjected to microwave drying in a batch using a microwave drying apparatus at a frequency of 2450 MHz, an output of 5 kW, and a heating time of 300 seconds to remove residual moisture (microwave drying process).

Next, a moisture content of the primary dried honeycomb formed body (honeycomb dried body) after the microwave drying was measured, and it was confirmed that the honeycomb dried body was dried. As a result, the moisture content of the honeycomb dried body was 2%.

Figure 3:
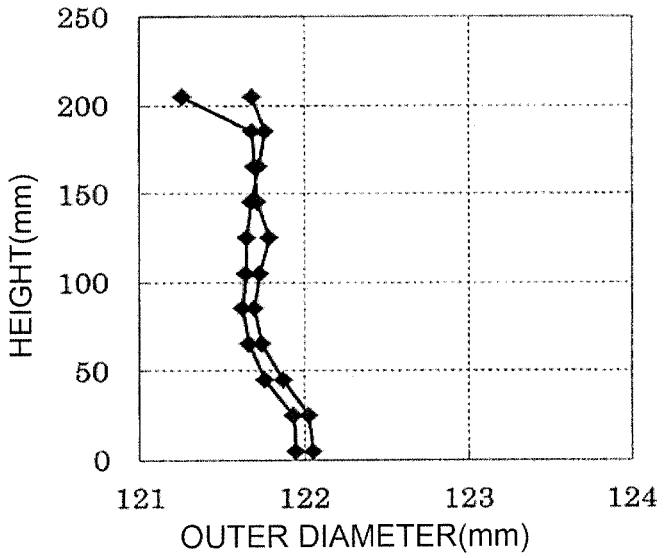
FIG. 3 is a graph showing measurement values of an outer diameter and a height of a honeycomb dried body after drying a honeycomb formed body in Example 1.
Figure 4:
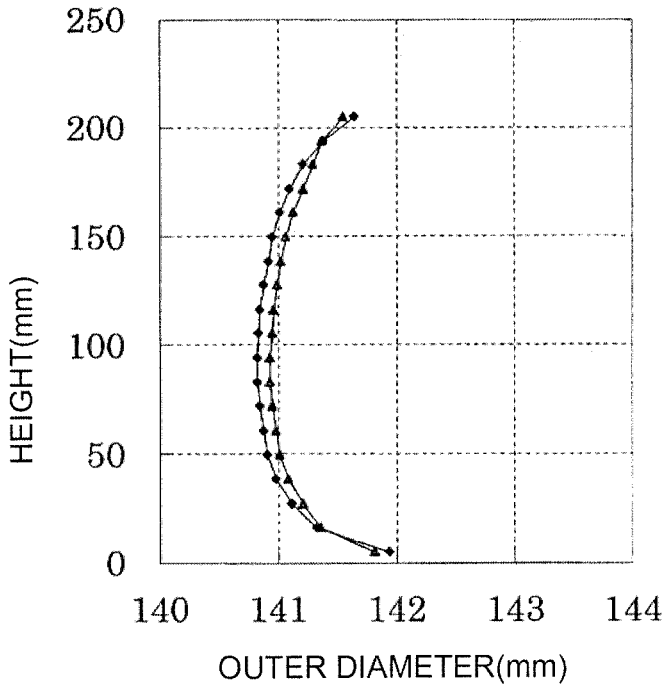
FIG. 4 is a graph showing measurement values of an outer diameter and a height of a honeycomb dried body after drying a honeycomb formed body in Example 5.
Figure 5:
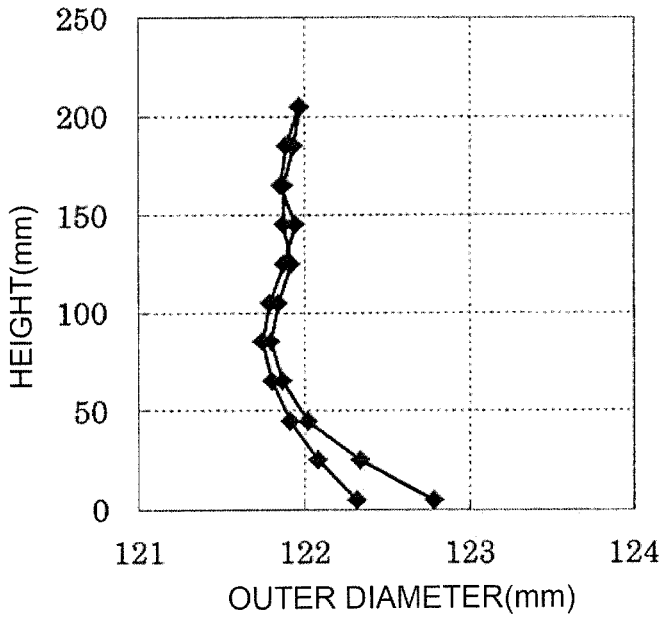
FIG. 5 is a graph showing measurement values of an outer diameter and a height of a honeycomb dried body after drying a honeycomb formed body in Comparative Example 1.
Figure 6:
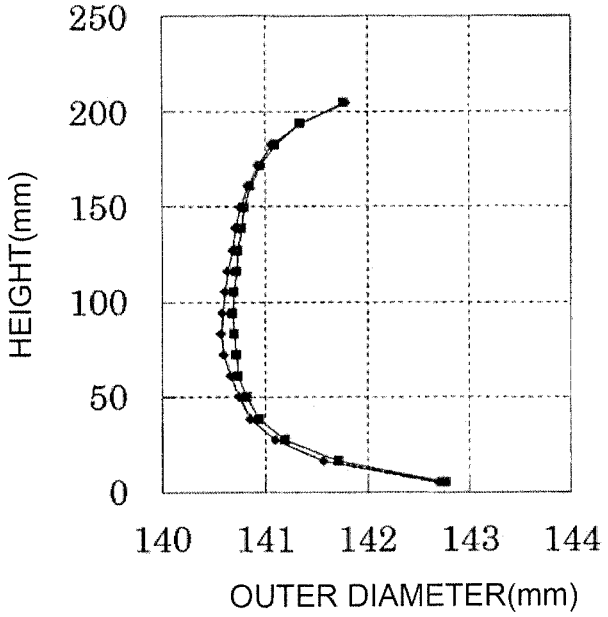
FIG. 6 is a graph showing measurement values of an outer diameter and a height of a honeycomb dried body after drying a honeycomb formed body in Comparative Example 3.

Further, with respect to the honeycomb dried body, the dimensions at a plurality of portions between a first end face as one end face and a second end face as the other end face were measured (FIG. 3 shows measurement results for the two honeycomb dried bodies). As a result, a difference (cylindricity) between the maximum dimension and the minimum dimension of the entire side face of the honeycomb dried body was 0.8 mm, and the honeycomb dried body of good quality could be obtained with high productivity. Note that the cylindricity was indicated as an average value in a plurality of honeycomb dried bodies. In FIG. 3, the term "height" means a position in the direction in which the cell was extended (the position in the X direction in FIG. 1). Further, in FIG. 3, the term "outer diameter" means a diameter of the honeycomb dried body (the maximum length in the Y direction in FIG. 1). This is equally applied to FIGS. 4 to 6. It is preferable that the cylindricity was 1 mm or less.

Further, the obtained honeycomb dried body was fired, and a difference (cylindricity) between a maximum dimension and a minimum dimension on the entire side face of a honeycomb fired body was calculated. As a result, the cylindricity was 1.0 mm. In this Example, it was possible to obtain a good-quality honeycomb structure having small dimensional difference at one end, the other end, and an intermediate portion thereof, with high productivity. Note that the firing conditions were conventionally known conditions (specifically, a maximum temperature of 1400° C. for 5 hours).

TABLE 1

| | Unfired Honeycomb Formed Body | | | | | | Moisture Content of | Moisture Content of | | Moisture Content of Primary Dried Honeycomb |
|---|---|---|---|---|---|---|---|---|---|---|
| | Shape | Diameter (mm) | Length (mm) | Thickness of Cell Wall (μm) | Weight Before Drying (g) | Number of Dried Honeycomb Formed Bodies | Unfired Honeycomb Formed Body (%) | Primary Dried Honeycomb Formed Body (%) | Moisture Removal Rate (%) | Formed Body After Micro-wave Drying (%) |
| Example 1 | Round Pillar | 126 | 220 | 210 | 1250 | 2 | 42 | 15 | 64 | 2 |
| Example 2 | Round Pillar | 126 | 220 | 210 | 1250 | 2 | 42 | 21 | 50 | 2 |
| Example 3 | Round Pillar | 126 | 220 | 210 | 1250 | 2 | 42 | 28 | 33 | 2 |
| Example 4 | Round Pillar | 146 | 220 | 63 | 1190 | 2 | 23 | 10 | 57 | 1 |
| Example 5 | Round Pillar | 146 | 220 | 63 | 1190 | 2 | 23 | 14 | 39 | 1 |
| Comparative Example 1 | Round Pillar | 126 | 220 | 210 | 1250 | 2 | 42 | 11 | 74 | 2 |
| Comparative Example 2 | Round Pillar | 126 | 220 | 210 | 1250 | 2 | 42 | 31 | 26 | 2 |
| Comparative Example 3 | Round Pillar | 146 | 220 | 63 | 1190 | 2 | 23 | 2 | 91 | — |
| Comparative Example 4 | Round Pillar | 146 | 220 | 63 | 1190 | 2 | 23 | 17 | 26 | 2 |

TABLE 2

| | Dielectric Drying Process | | | Temperature of Central | Microwave Drying Process | | | Honeycomb Dried Body | | | Honeycomb Structure |
|---|---|---|---|---|---|---|---|---|---|---|---|
| | Frequency (MHz) | Output (kW) | Time (seconds) | Portion (° C.) | Frequency (MHz) | Output (kW) | Time (seconds) | Maximum Dimension (mm) | Minimum Dimension (mm) | Cylindricity (mm) | Cylindricity (mm) |
| Example 1 | 13 | 5 | 500 | 100 | 2450 | 5 | 300 | 122.3 | 121.5 | 0.8 | 1.0 |
| Example 2 | 13 | 5 | 400 | 100 | 2450 | 5 | 400 | 122.0 | 121.4 | 0.6 | 0.7 |
| Example 3 | 13 | 5 | 250 | 100 | 2450 | 5 | 500 | 122.2 | 121.4 | 0.8 | 0.9 |
| Example 4 | 40 | 10 | 120 | 100 | 2450 | 10 | 90 | 142.2 | 141.3 | 0.9 | 1.0 |
| Example 5 | 40 | 10 | 80 | 100 | 2450 | 10 | 120 | 141.9 | 141.0 | 0.9 | 1.0 |
| Comparative Example 1 | 13 | 5 | 550 | 130 | 2450 | 5 | 200 | 122.6 | 121.2 | 1.4 | 1.6 |
| Comparative Example 2 | 40 | 10 | 100 | 100 | 2450 | 10 | 280 | 122.4 | 121.2 | 1.2 | 1.5 |
| Comparative Example 3 | 40 | 10 | 200 | 115 | 2450 | 10 | 0 | 142.7 | 140.6 | 2.1 | 2.5 |
| Comparative Example 4 | 40 | 10 | 60 | 115 | 2450 | 10 | 150 | 142.2 | 140.8 | 1.4 | 1.8 |

Examples 2 to 5 and Comparative Examples 1 to 4

An unfired honeycomb formed body was dried in a manner similar to the manner in Example 1 except for changing conditions as shown in Tables 1 and 2. Results in this drying method were shown in Tables 1 and 2.

In Examples 4 and 5, a moisture content of the unfired honeycomb formed body was 23%. Further, in Comparative Example 2, the same honeycomb formed body as the unfired honeycomb formed body used in Example 1 was used, and a dried honeycomb formed body from which 26% of the entire moisture contained in the unfired honeycomb formed body before the drying was removed was obtained. In Comparative Example 2, breakage occurred in the honeycomb formed body when shifting from the dielectric drying process to the microwave drying process. Note that the term "breakage" means a state in which a partition wall of the honeycomb formed body was partially broken.

Note that, in Examples 2 to 5 and Comparative Examples 1 to 4, cylindricity after firing the obtained honeycomb dried body was measured similarly to Example 1. The results are shown in Table 2.

It can be appreciated from Tables 1 and 2 that according to the method for drying the honeycomb formed bodies of Examples 1 to 5, the drying distribution was small as compared with the method for drying the honeycomb formed bodies of Comparative Examples 1 to 4, and uniform drying was possible, such that it was possible to obtain a honeycomb dried body having good quality with high productivity.

Further, the obtained honeycomb structure had good cylindricity, and it can be appreciated that with the method for manufacturing a honeycomb structure according to the present invention, it is possible to obtain a honeycomb structure having good quality with high productivity.

INDUSTRIAL APPLICABILITY

A method for drying a honeycomb formed body according to the present invention is preferably used as a manufacturing process of a filter purifying exhaust gas of a vehicle or the like. A method for manufacturing a honeycomb structure according to the present invention is preferably used as a method for manufacturing a filter purifying exhaust gas of a vehicle or the like.

DESCRIPTION OF REFERENCE NUMERALS

1: cell wall, 2: cell, 11: first end face, 12: second end face, 100: honeycomb formed body, X: direction in which a cell extends (height), and Y: diameter (outer diameter).

The invention claimed is:

1. A method for drying a honeycomb formed body, the honeycomb formed body being an unfired honeycomb formed body including a raw material composition containing a ceramic raw material and water, and including a cell wall that defines and forms a plurality of cells extended from a first end face as one end face to a second end face as the other end face, the method comprising:

a dielectric drying process of obtaining a primary dried honeycomb formed body from which 30 to 57% of entire moisture contained in the unfired honeycomb formed body before the drying is removed by performing dielectric drying on the unfired honeycomb formed body while maintaining a temperature of a central portion of the unfired honeycomb formed body at 100° C. or less; and a microwave drying process of obtaining a honeycomb dried body from which residual moisture is removed by performing microwave drying on the primary dried honeycomb formed body obtained in the dielectric drying process.

2. The method for drying a honeycomb formed body according to claim 1, wherein a moisture content of the unfired honeycomb formed body before the drying subjected to the dielectric drying process is 20 to 60%.

3. The method for drying a honeycomb formed body according to claim 1, wherein the unfired honeycomb formed body subjected to the dielectric drying process has a round pillar shape, a diameter of the end face of the unfired honeycomb formed body is 50 to 200 mm, a length of the unfired honeycomb formed body in a direction in which the cell extends is 150 to 350 mm, and a thickness of the cell wall of the unfired honeycomb formed body is 50 to 350 μm.

4. A method for manufacturing a honeycomb structure, the method comprising:

a honeycomb formed body manufacturing process of manufacturing a honeycomb formed body by kneading a raw material obtained by adding additives to a ceramic material to form a kneaded material and extruding the kneaded material in a honeycomb shape;

a drying process of obtaining a honeycomb dried body by drying the manufactured honeycomb formed body using the method for drying a honeycomb formed body according to claim 1; and a firing process of obtaining the honeycomb structure by firing the obtained honeycomb dried body.

* * * * *